US012359401B2

(12) United States Patent
Chinnock et al.

(10) Patent No.: US 12,359,401 B2
(45) Date of Patent: Jul. 15, 2025

(54) WORK MACHINE WITH POWER OPTIMIZATION

(71) Applicant: The Toro Company, Bloomington, MN (US)

(72) Inventors: Eric Medin Chinnock, Waconia, MN (US); Elyssa Michelle Debelak, Savage, MN (US); Richard Tyler Havlik, Waconia, MN (US)

(73) Assignee: The Toro Company, Bloomington, MN (US)

( * ) Notice: Subject to any disclaimer, the term of this patent is extended or adjusted under 35 U.S.C. 154(b) by 0 days.

(21) Appl. No.: 18/467,498

(22) Filed: Sep. 14, 2023

(65) Prior Publication Data

US 2024/0093466 A1 Mar. 21, 2024

Related U.S. Application Data

(60) Provisional application No. 63/376,029, filed on Sep. 16, 2022.

(51) Int. Cl.
*E02F 9/22* (2006.01)
*E02F 9/20* (2006.01)

(52) U.S. Cl.
CPC ..... *E02F 9/2235* (2013.01); *E02F 9/2253* (2013.01); *E02F 9/2296* (2013.01); *E02F 9/2066* (2013.01); *E02F 9/207* (2013.01)

(58) Field of Classification Search
CPC ..... E02F 9/2066; E02F 9/207; E02F 9/2246; E02F 9/225; E02F 9/2253
See application file for complete search history.

(56) References Cited

U.S. PATENT DOCUMENTS

| | | | |
|---|---|---|---|
| 3,750,762 | A | 8/1973 | Eaton |
| 4,230,372 | A | 10/1980 | Marten |
| 4,423,785 | A | 1/1984 | Kurihara et al. |
| 4,455,770 | A | 6/1984 | Presley |
| 4,542,940 | A | 9/1985 | Marten |
| 4,699,239 | A | 10/1987 | Ishino et al. |
| 6,385,970 | B1 | 5/2002 | Kuras et al. |
| 6,658,767 | B2 | 12/2003 | Kelly et al. |
| 6,675,577 | B2 | 1/2004 | Evans |
| 6,892,517 | B2 | 5/2005 | Adams et al. |
| 7,644,524 | B2 | 1/2010 | Azure et al. |

(Continued)

*Primary Examiner* — Michael Leslie
(74) *Attorney, Agent, or Firm* — Merchant & Gould P.C.

(57) ABSTRACT

A mobile work machine is provided with a prime mover supported by a chassis, a first hydraulic pump driven by the prime mover, a work attachment powered by the prime mover, and a traction system. The traction system can include a ground engagement assembly for propelling the chassis. The mobile work machine can include an electronic controller configured to execute a traction speed control algorithm in which the position of the power reduction device is operated by the electronic controller to reduce available fluid pressure to a traction control device without receiving an actual traction speed feedback signal at the electronic controller. Alternatively, or in addition, a commanded position of the power reduction control device can be calculated by the electronic controller as a function of a requested prime mover operating speed demand reduced by a calculated adjustment factor.

19 Claims, 7 Drawing Sheets

(56) References Cited

U.S. PATENT DOCUMENTS

| | | | | |
|---|---|---|---|---|
| 7,930,843 | B2 | 4/2011 | Hartwick | |
| 8,572,939 | B2 | 11/2013 | Koike et al. | |
| 8,880,300 | B2 | 11/2014 | Gamble et al. | |
| 9,002,585 | B2 | 4/2015 | Porter et al. | |
| 9,037,360 | B2 | 5/2015 | Vora et al. | |
| 9,113,596 | B2 | 8/2015 | Bricko et al. | |
| 9,179,596 | B2 | 11/2015 | Phillips et al. | |
| 9,303,633 | B2 | 4/2016 | Maiyur et al. | |
| 9,338,940 | B2 | 5/2016 | Bejcek et al. | |
| 9,475,497 | B2 | 10/2016 | Henson et al. | |
| 9,599,107 | B2 | 3/2017 | Wu et al. | |
| 9,615,508 | B2 | 4/2017 | Ito et al. | |
| 9,635,806 | B2 | 5/2017 | Waitt et al. | |
| 9,989,042 | B2 * | 6/2018 | Hoxie | F04B 49/00 |
| 10,306,828 | B2 | 6/2019 | Kuriyagawa et al. | |
| 10,595,459 | B2 | 3/2020 | Aposhian et al. | |
| 10,856,465 | B2 | 12/2020 | Andre et al. | |
| 10,941,541 | B2 | 3/2021 | Kukuk et al. | |
| 11,206,759 | B2 | 12/2021 | Gust et al. | |
| 11,208,786 | B2 | 12/2021 | Carlson et al. | |
| 11,293,333 | B2 | 4/2022 | Frick et al. | |
| 11,788,255 | B2 * | 10/2023 | Fukuda | F16H 61/44 701/50 |
| 2008/0034720 | A1 | 2/2008 | Helfrich et al. | |
| 2016/0244937 | A1 † | 8/2016 | Azure | |
| 2020/0305341 | A1 | 10/2020 | Mayefske et al. | |
| 2021/0054598 | A1 | 2/2021 | Kukuk et al. | |
| 2021/0180292 | A1 | 6/2021 | Kukuk et al. | |
| 2021/0235621 | A1 | 8/2021 | Pankaj et al. | |
| 2021/0259150 | A1 | 8/2021 | Sipper et al. | |
| 2021/0404150 | A1 † | 12/2021 | Fukuda | |
| 2022/0087092 | A1 | 3/2022 | Nakabayashi et al. | |

* cited by examiner
† cited by third party

WORK MACHINE WITH POWER OPTIMIZATION

CROSS-REFERENCE TO RELATED APPLICATION

This application claims priority to U.S. Provisional Patent Application Ser. No. 63/376,029, filed Sep. 16, 2022, the entirety of which is hereby incorporated by reference.

BACKGROUND

Many mobile work machines, such as compact utility loaders, are typically provided with a single power plant, such as an internal combustion engine, that powers multiple work functions. For example, the power plant can be used to propel the work machine via a traction system and can also be used to simultaneously power a work attachment. In some instances, the total load on the power plant can exceed the actual capacity of the power plant such that power to one or both of the traction system and the work attachment must be reduced. Control systems which allocate power under such conditions are known. However, such systems frequently increase cost and add complexity. Improvements are desired.

SUMMARY

In general terms, this disclosure is directed to mobile work machines with active controls that vary available power to a traction system while minimizing engine stalling, maximizing the amount of work being achieved, and optimizing machine power for multiple different work scenarios. Various aspects are described in this disclosure, which include, but are not limited to, the following aspects.

In one example, a mobile work machine is provided with a prime mover supported by a chassis, a work attachment powered by the prime mover, and a traction system. In one aspect, the traction system can include a ground engagement assembly for propelling the chassis, a hydraulic pump driven by the prime mover, a hydraulic motor for driving the ground engagement assembly, the hydraulic motor being powered by the hydraulic pump, a user-operated traction control device for controlling a hydraulic fluid flow to a control input of the hydraulic pump, and a power reduction device for controlling a hydraulic fluid flow to the traction control device.

The mobile work machine can also include an electronic controller for operating the prime mover and the power reduction device. The electronic controller can be configured to operate the prime mover at a requested operating speed based on a user-selected input, monitoring an actual operating speed of the prime mover. In one aspect, the electronic controller can also be configured to execute a traction speed control algorithm when the actual operating speed of the prime mover relative to the requested operating speed meets a threshold condition in which the position of the power reduction device is operated by the electronic controller to reduce available fluid pressure to the traction control device without receiving an actual traction speed feedback signal at the electronic controller. Alternatively, or in addition, the electronic the traction speed control algorithm can include operating the position of the power reduction device to reduce available fluid pressure to the traction control device, wherein a commanded position of the power reduction control device is calculated by the electronic controller as a function of a requested prime mover operating speed demand reduced by a calculated adjustment factor.

In some examples associated with the first aspect, the hydraulic motor includes a first hydraulic motor for driving a first traction member of the ground engagement assembly and includes a second hydraulic motor for driving a second member of the ground engagement assembly.

In some examples, the hydraulic pump includes a first hydraulic pump and a second hydraulic pump, wherein the traction control device includes a first traction control device for controlling hydraulic fluid flow from the first hydraulic pump to the first hydraulic motor and includes a second traction control device for controlling hydraulic fluid flow from the second hydraulic pump to the second hydraulic motor.

In some examples, the power reduction device controls flow to both the first and second traction control devices.

In some examples, the power reduction device is a control valve assembly.

In some examples, the traction control device delivers hydraulic fluid used as pilot pressure to control the position of a swashplate of the hydraulic pump.

In some examples, the electronic controller prevents the traction speed control algorithm from being executed unless a qualifying condition is present.

In some examples, the qualification condition includes one or more of: a condition in which a speed command of the traction system is not null; a condition in which the speed command of the traction system is above a threshold value; a condition in which the actual operating speed of the prime mover is above a minimum threshold; a condition in which the requested prime mover operating speed is increasing but where the actual operating speed of the prime mover is decreasing by more than a deadband region; and a condition in which the requested prime mover operating speed is increasing but where the actual operating speed of the prime mover is outside of the deadband region.

In some examples, a commanded position of the power reduction device is calculated by the electronic controller as a function of a requested prime mover operating speed demand and a calculated adjustment factor.

In some examples, the mobile work machine is a compact utility loader with operator controls and a standing platform located at a rear end of the work machine.

In some examples, the prime mover is an internal combustion engine.

In some examples, the position of the power reduction control valve assembly is calculated without receiving an actual traction speed feedback signal at the electronic controller.

In some examples, a mobile work machine includes a prime mover supported by a chassis, a traction system, a work attachment powered by the prime mover, and an electronic controller. In one aspect, the traction system can include: a ground engagement assembly for propelling the chassis; a hydraulic motor for driving the ground engagement assembly; a user-operated traction control device for controlling hydraulic fluid flow to the hydraulic motor; and a power reduction device for controlling hydraulic fluid flow to the traction control device. In one aspect, the electronic controller can operate the prime mover and the power reduction device and is configured to: operate the prime mover at a requested operating speed based on a user-selected input; monitor an actual operating speed of the prime mover; and execute a traction speed control algorithm when the actual operating speed of the prime mover relative to the requested operating speed meets a threshold condition, in which the position of the power reduction device is operated by the electronic controller to reduce available fluid pressure to the traction control device, wherein a commanded position of the power reduction device is calculated by the electronic controller as a function of a requested prime mover operating speed demand reduced by a calculated adjustment factor.

In some examples, the position of the power reduction device is calculated without receiving an actual traction speed feedback signal at the electronic controller.

In some examples, the traction control device includes a first traction control device for controlling hydraulic fluid flow from a first hydraulic pump to a first hydraulic motor and includes a second traction control device for controlling hydraulic fluid flow from a second hydraulic pump to a second hydraulic motor, and wherein the power reduction device controls flow from the first and second hydraulic pumps to the first and second traction control devices.

In some examples, the power reduction device is a control valve assembly and the prime mover is one or both of an internal combustion engine and an electric motor.

In some examples, the traction control valve assembly delivers hydraulic fluid used as pilot pressure to control the position of a swashplate of the first and second hydraulic pumps.

In some examples, the electronic controller prevents the traction speed control algorithm from being executed unless a qualifying condition is present.

In one example, a method for controlling the speed of a mobile work machine having a prime mover powering a traction system and at least one work implement is presented. The method can include the steps of operating the prime mover at a requested operating speed based on a user-selected first input; operating the traction system based on a user-selected second input to a hydraulic traction control device; monitoring an actual operating speed of the prime mover; executing a traction speed control algorithm, when the actual operating speed of the prime mover relative to the requested operating speed meets a threshold condition, in which a position of a power reduction device is operated by the electronic controller to reduce available fluid pressure to the traction control device, wherein a commanded position of the power reduction control device is calculated by the electronic controller as a function of a requested prime mover operating speed demand reduced by a calculated adjustment factor.

In some examples of the method, a position of the power reduction control device is calculated without receiving an actual traction speed feedback signal at the electronic controller.

In some examples, the method can include preventing the traction speed control algorithm from being executed unless a qualifying condition is present, wherein the qualifying condition includes one or more of: a condition in which a speed command of the traction system is not null; a condition in which the speed command of the traction system is above a threshold value; a condition in which the actual operating speed of the prime mover is above a minimum threshold; a condition in which the requested prime mover operating speed is increasing but where the actual operating speed of the prime mover is decreasing by more than a deadband region; and a condition in which the requested prime mover operating speed is increasing but where the actual operating speed of the prime mover is outside of the deadband region.

DETAILED DESCRIPTION

Figure 1:
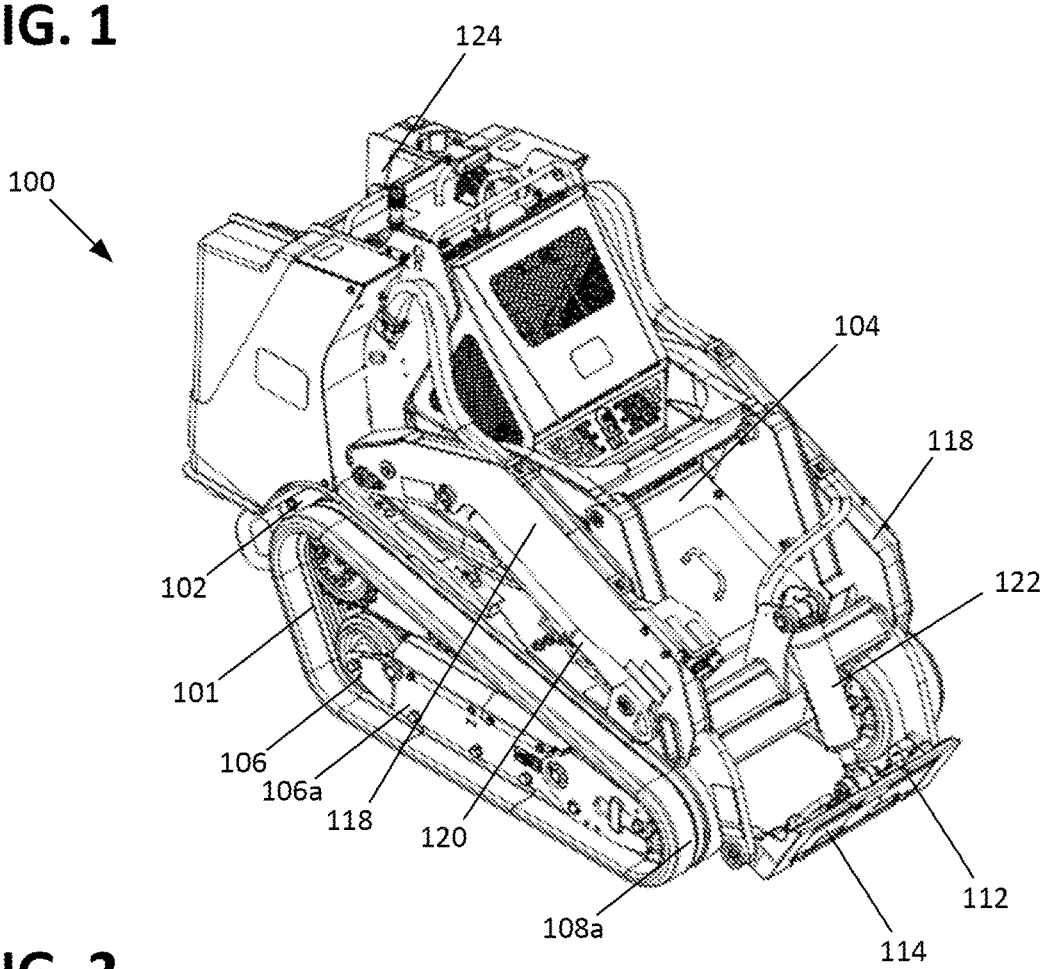
FIG. 1 is a front perspective view of an example work machine having features in accordance with the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIGS. 1 to 4, an example work machine 100 is presented. In the example shown, the work machine 100 is a compact utility loader. In generalized terms, compact utility loaders can be characterized as including tracks or wheels, a front-mounted work attachment, and a control station located at the rear, wherein the operator either walks behind the loader or stands on a support platform of the loader. These features and others are described in more detail in the following paragraphs.

In one aspect, the work machine 100 is provided with a chassis 102 supporting a power plant 104. In the example shown, the power plant 104 is an internal combustion engine. However, other types of power plants may be provided. For example, the power plant 104 can include one or more electric motors or can be configured as a hybrid power plant including an internal combustion engine and an electric motor. Other types of power plants are also possible.

The work machine 100 is also provided with a traction system 101 including a ground engagement assembly 106 that supports the chassis 102 and enables the work machine 100 to move over the ground. In one aspect, the ground engagement assembly 106 includes first and second ground engagement assemblies 106*a*, 106*b* mounted to opposite sides of the chassis 102. In the example shown, each of the ground engagement assemblies 106*a*, 106*b* is provided with a traction member 108*a*, 108*b* in the form of a track which is driven by power received from the power plant 102. Other types of ground engagement assemblies and traction members are possible. For example, the work machine 100 can be provided with wheels instead of tracks.

Figure 2:
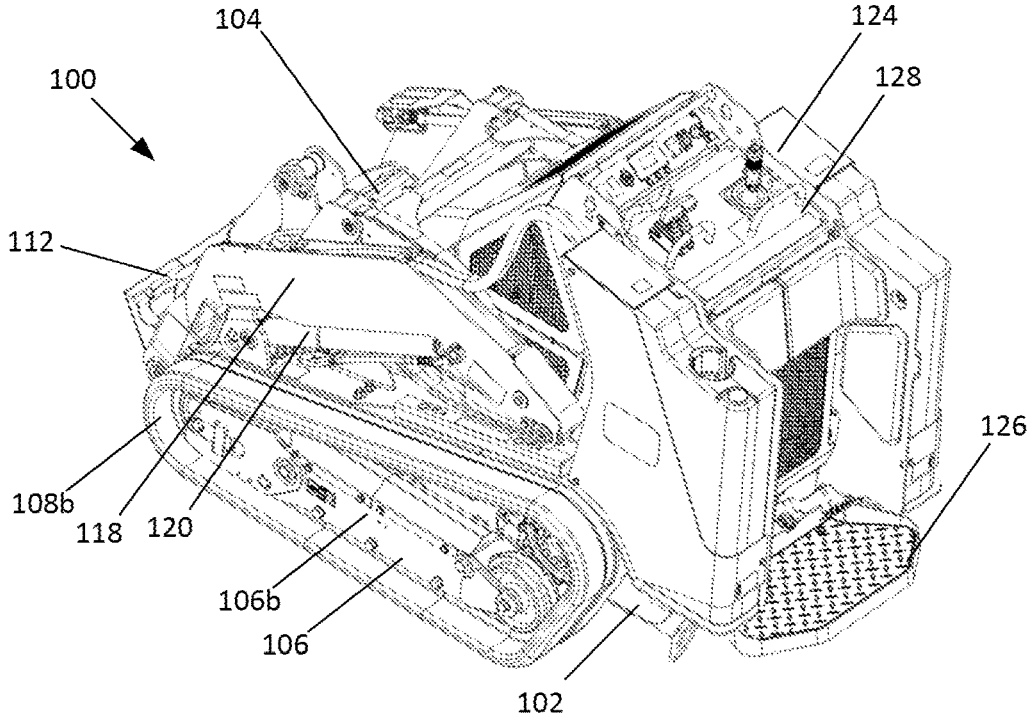
FIG. 2 is a rear perspective view of the work machine shown in FIG. 1.
Figure 3:
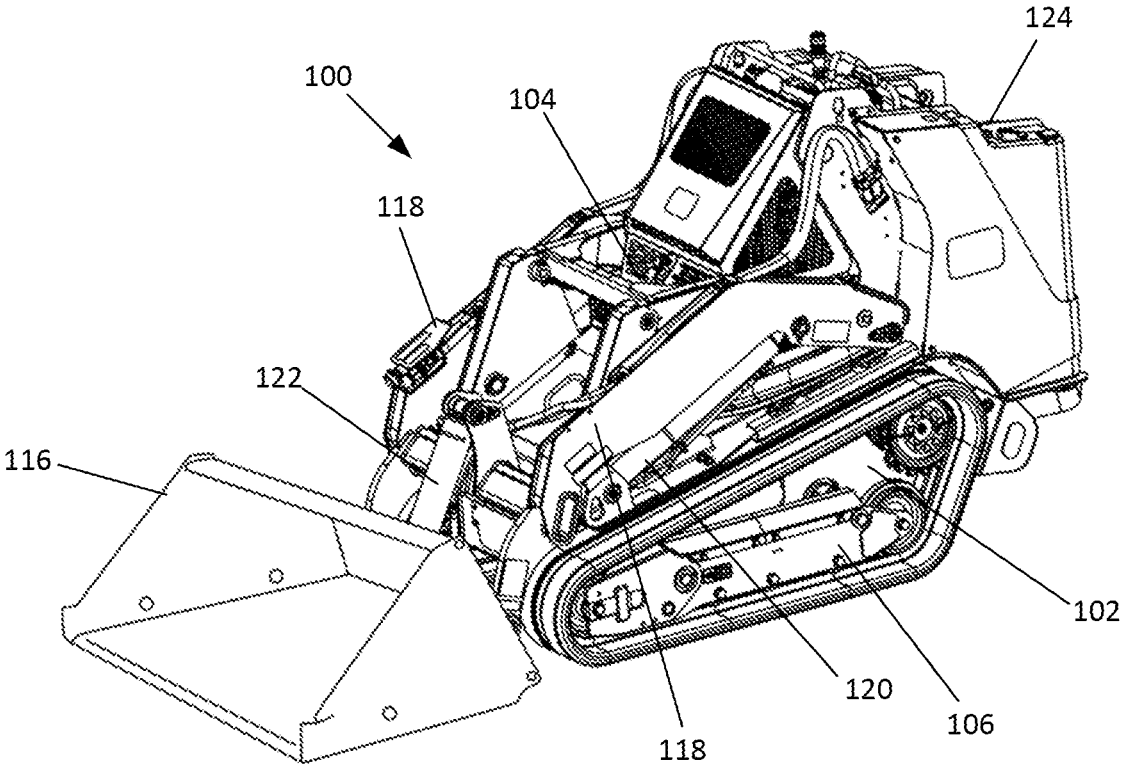
FIG. 3 is a front perspective view of the work machine shown in FIG. 1, with a work attachment mounted to the work machine.

The work machine 100 is further provided with a work assembly 112 including a mounting assembly 114 to which a work attachment 116 can be attached. FIGS. 1 and 2 show the mounting assembly 114 without a work attachment mounted, while FIG. 3 shows a mounted work attachment 116 in the form of a bucket. The work machine is configured to accept a number of different types of work attachments. Non-limiting examples of work attachments 116 that can be used with the work machine are a trencher attachment, a snow thrower attachment, a forklift attachment, a trench filler attachment, and a tiller attachment. Many other types of work attachments can be used with the work machine 100 without departing from the concepts herein. In one aspect, the mounting assembly 114 is operably supported by a pair of loader arm assemblies 118 which are in turn operated by a pair of actuators 120. The mounting assembly 114 is also operably connected to an actuator 122 such that the mounting assembly 114 can be moved with respect to the loader arm assemblies 118. In some examples, two parallel actuators 122 are provided to power movements of the work attachment 116. In the example shown, the actuators 120, 122 are linear hydraulic actuators. Other types of actuators are possible. For example, the actuators 120, 122 could be hydraulic or electric motors. The work assembly 112 can also be provided with further attachments and connections to provide fluid or electric power to the work attachment. For example, the work assembly 112 can be provided with a hydraulic fluid connection to power the rotary action of a snow thrower work attachment.

Figure 4:
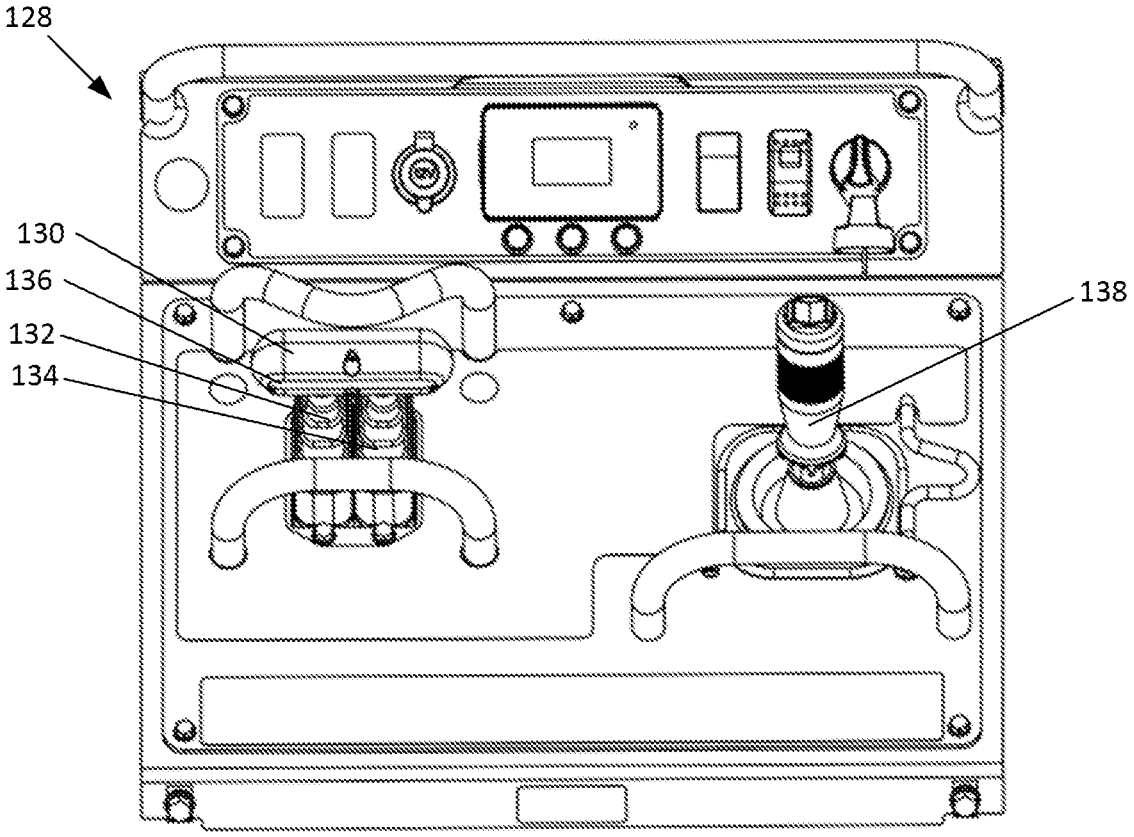
FIG. 4 is a top view of a control panel associated with the work machine shown in FIG. 1.

With continued reference to FIGS. 1 to 4, the work machine 100 is further shown as being provided with an operator station 124 located at the rear of the work machine. In one aspect, the operator station 124 includes a platform 126 for supporting a standing operator. In another aspect, the operator station 122 includes a control panel 128 to enable the operator to control the various functions of the work machine, such as forward, reverse, and turning movements, and operation of the work attachment. Referring to FIG. 4, an example control panel 128 is shown in further detail. In one aspect, the control panel 128 is provided with a traction control input 130 including a first control lever 132, a second control lever 134, and a handle 136 connected to each of the control levers 132, 134. In operation, the handle 136 can be moved straight forward or backward for forward and reverse operation of the work machine 100 via the traction system 101 and/or can be twisted in a clockwise or counterclockwise direction to effectuate turning of the work machine 100. The configuration and operation of the traction control input 130 is described in further detail below. The control panel 128 is also shown as including a work attachment input 138 from which the motions of the work attachment can be effectuated. The work attachment input 138 can be configured as an input to an electronic control system or configured as a mechanical input to one or more control valves associated with the work attachment actuators 120, 122. The control panel 128 may be provided with a plurality of other inputs 138 for controlling the work functions of the work machine 100. For example, the input 138 can include one input for the operation of the actuators 120, one input for the operation of actuator 122, and another input for the operation of an additional work function, for example, flow from a hydraulic connection point or PTO (power take-off)_attachment point for the work attachment 116. The control panel 128 may also include an input to a controller 500, discussed below, for an operator to selectively enable or disable the execution of the traction control algorithm.

Figure 5:
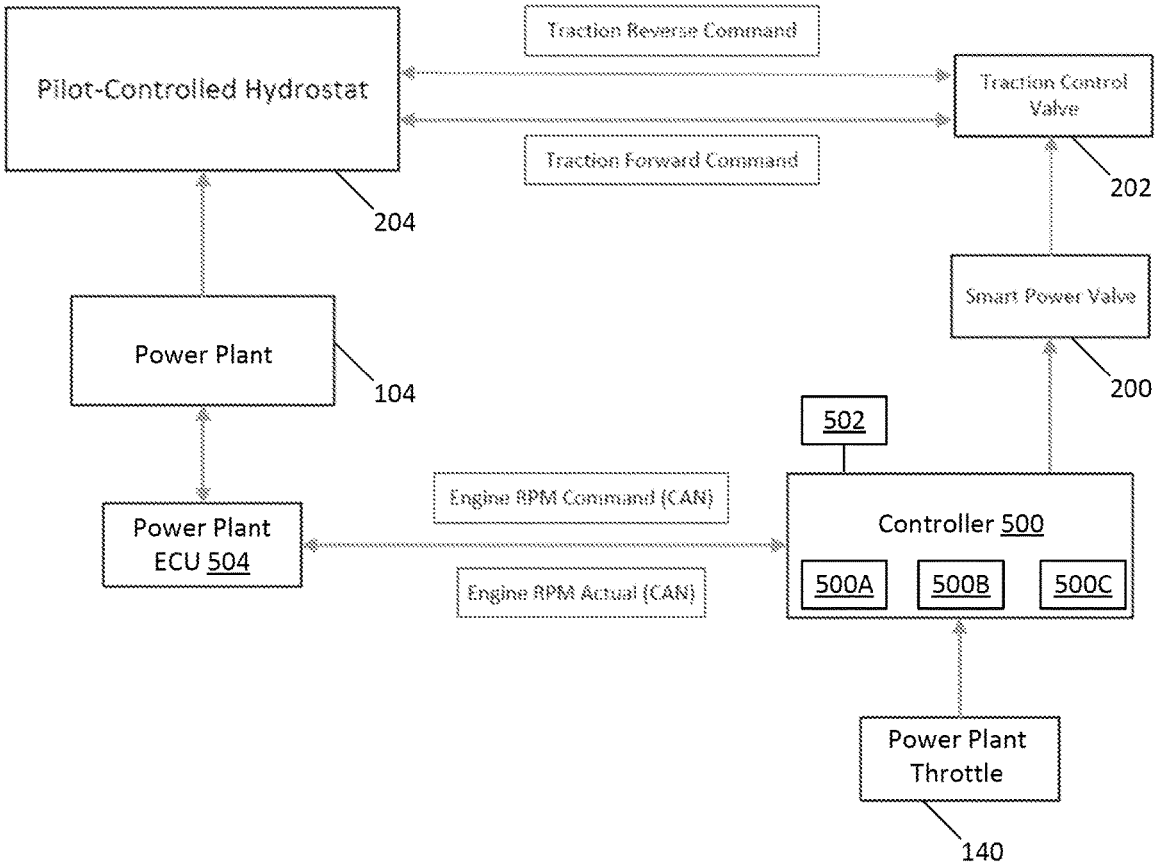
FIG. 5 is a schematic view of a control system associated with the work machine of FIG. 1.
Figure 6:
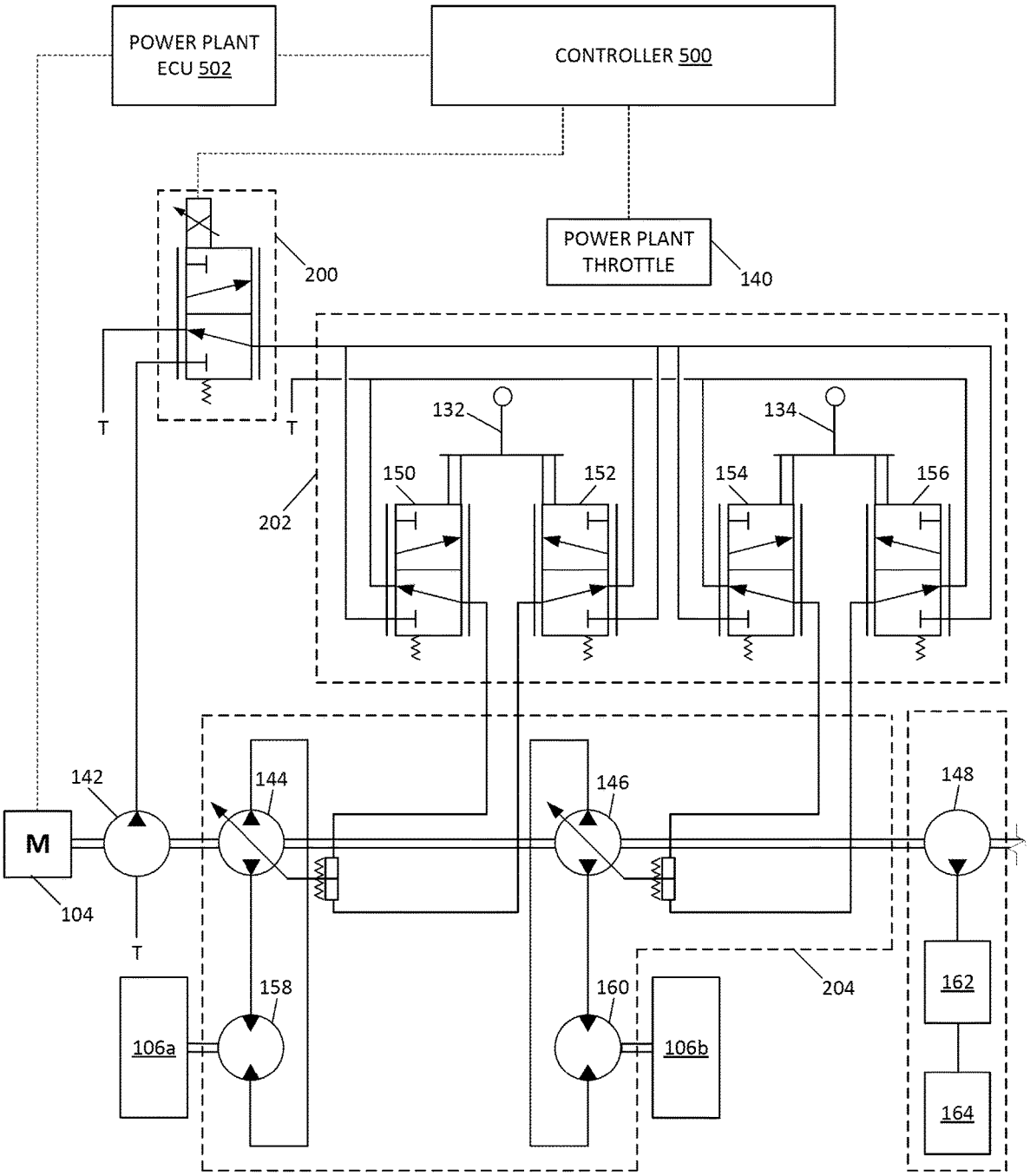
FIG. 6 is a schematic view of the control system shown in FIG. 4, showing further detail with regard to an exemplary associated hydraulic system.

Referring to FIGS. 5 and 6, aspects of the hydraulic and control systems for the work machine 100 are shown in further detail. FIG. 5 presents a schematic of the control components of the work machine 100 that are associated with a traction speed control algorithm, discussed later herein, while FIG. 6 presents a more specific example. It should be understood that the schematics of FIGS. 5 and 6 are not intended to show every component that would be installed in an actual system, and that would be apparent to a person having skill in the art upon learning of the disclosure, and instead focus on those features relevant to the present disclosure.

As shown in FIG. 5, an electronic controller 500 is provided for executing the traction speed control algorithm. In one aspect, the controller 500 includes a processor 500A and a non-transient storage medium or memory 500B, such as RAM, a flash drive, or a hard drive. Memory 500B is for storing executable code, the operating parameters, and the input from a operator user interface 502, while processor 500A is for executing the code. Memory 500B can also be for storing reference information such as maps and/or lookup tables. The electronic controller is also shown as including a transmitting/receiving port 500C, such as an Ethernet port for two-way communication with a WAN/LAN related to an automation system. The user interface 502 may be provided, for example at the control panel 128, to activate and deactivate the system, allow a user to manipulate certain settings or inputs to the controller 500, and to view information about the system operation. The electronic controller 500 typically includes at least some form of memory 500B. Examples of memory 500B include computer readable media. Computer readable media includes any available media that can be accessed by the processor 500A. By way of example, computer readable media include computer readable storage media and computer readable communication media. Computer readable storage media includes volatile and nonvolatile, removable and non-removable media implemented in any device configured to store information such as computer readable instructions, data structures, program modules, or other data. Computer readable storage media includes, but is not limited to, random access memory, read only memory, electrically erasable programmable read only memory, flash memory or other memory technology, compact disc read only memory, digital versatile disks or other optical storage, magnetic cassettes, magnetic tape, magnetic disk storage or other magnetic storage devices, or any other medium that can be used to store the desired information and that can be accessed by the processor 500A. Computer readable communication media typically embodies computer readable instructions, data structures, program modules, or other data in a modulated data signal such as a carrier wave or other transport mechanism and includes any information delivery media. The term "modulated data signal" refers to a signal that has one or more of its characteristics set or changed in such a manner as to encode information in the signal. By way of example, computer readable communication media includes wired media such as a wired network or direct-wired connection, and wireless media such as acoustic, radio frequency, infrared, and other wireless media. Combinations of any of the above are also included within the scope of computer readable media.

With continued reference to FIG. 5, the electronic controller 500 is also shown as having a number of inputs/outputs that may be used for operating the work machine 100 and executing the traction control algorithm. For example, the controller 500 can send commands to and receive feedback from a power plant electronic control unit (ECU) 504. The controller 500 can also be configured to send an engine RPM command to the ECU 504 based on a power plant throttle input 140 received by the controller 500. The power plant throttle input 140 may be any type of input, such as a lever or dial located at the control panel 128. The electronic controller 500 can also receive inputs from the ECU 502, such as a signal associated with actual engine RPM. The electronic controller 500 is also shown as providing an output to a smart power valve 200. As explained further below, when the smart power algorithm is executed, the controller 500 activates the smart power valve 200 to reduce available hydraulic fluid pressure and flow to a traction control valve assembly 202, and thus to a downstream hydrostat 204 driving the traction system 101. Consequently, the load demand on the power plant 104 caused by the hydrostat 204 driving the traction system 101 is reduced such that more power is made available to the work attachment functions. The electronic controller 500 may be provided with additional input and/or output functions.

With reference to FIG. 6, an example hydraulic and control system in accordance with the schematic of FIG. 5 is presented. As shown, the power plant 104 is provided with an output shaft operably driving hydraulic pumps 142, 144, 146, and 148. Other means for driving pumps 142, 144, 146, 148 are possible; for example, the pumps could be driven by a belt, chain, drive shaft, and/or driven via a gear box or transmission coupled to the power plant 104. In one aspect, the hydraulic pump 142 provides hydraulic fluid power to the traction control system 101. The traction control system 101 is provided with a first pair of oppositely arranged control valves 150, 152, operated by the input control lever 132, and is provided with a second pair of oppositely arranged control valves 154, 156, operated by the input control lever 134. The control valves 150, 152 provide pilot pressure to a swashplate associated with the pump 144, while the control valves 154, 156 provide pilot pressure to a swashplate associated with the pump 146. As such, the control valves 150/152 and 154/156 can respectively be characterized as controlling a hydraulic fluid flow from the hydraulic pump 142 to a control input of the pumps 144, 146. The pumps 144, 146 are hydraulically connected to hydraulic motors 158, 160, which in turn drive the first and second ground engagement assemblies 106*a*, 106*b*, respectively. Accordingly, when the input control levers 132 and/or 134 are moved in a first direction, the valves 150/152, 154/156 pilot the swashplate of the respective pump 144, 146 towards a first end position such that the hydraulic motors 158, 160 are driven in a first direction such that the ground engagement assemblies 106*a*, 106*b* are driven in the first direction (e.g., a forward direction). Similarly, when the input control levers 132 and/or 134 are moved in a second direction opposite the first direction, the valves 150/152, 154/156 pilot the swashplate of the respective pump 144, 146 towards a second opposite end position such that the hydraulic motors 158, 160 are driven in a second direction such that the ground engagement assemblies 106*a*, 106*b* are driven in the second direction (e.g., a reverse direction). Notably, the levers 132, 134 are independently operably such that it is possible for one ground engagement assembly to drive in the first direction and for the other ground engagement assembly to drive in the second direction, thus resulting in a turning operation of the work machine 100. In one aspect, the traction control system 101 can be characterized as being manually or mechanically operated as the input from the user directly acts on the valves, in contrast to systems where the user input is an electronic input to a controller that then outputs an electronic control signal to operate the traction system.

In one aspect, the smart power valve 200 is hydraulically located between the pump 142 and the traction control valve assembly 202. In this position, the smart power valve 200 can be operated to control fluid pressure and flow from the pump 142 to the traction control valve assembly 202, and more specifically to the swashplate pilot control inputs of the pumps 144, 146. When the traction control algorithm is executed, the smart power valve 200 is operated towards a closed position such that available hydraulic pressure and flow from the pump 142 to the traction control valve assembly 202 is reduced. This reduction in turn limits the extent to which the swashplates of the pumps 144, 146 can be operated and thus reduces the maximum output of the pumps 144, 146. This operation results in the reduction of the maximum load placeable on the power plant 104 from the pumps 144, 146 while also reducing the maximum output of the hydraulic motors 158, 160, and thus the maximum achievable ground speed of the work machine 100.

With continued reference to FIG. 6, the pump 148 provides fluid power to work functions of the work machine 100 via a control valve 162 and actuator 164. Although a single pump 148, control valve 162, and actuator 164 are schematically depicted, multiple pumps, valves, and/or actuators may be provided. For example, and with additional reference to FIGS. 1 and 2, the actuator 164 may include two actuators 120 and 122 which may be controlled by one or more control valves 162 based on one or more inputs from the control panel, for example via input(s) 138. The input(s) 138 may be either directly coupled to a control valve 162 or may provide an electronic input to the controller 500, which in turn provides an electronic output to the actuator. Additional pumps, control valves, and/or actuators may be provided to accomplish additional work functions, for example for an additional hydraulic connection point and/or PTO.

Figure 7:
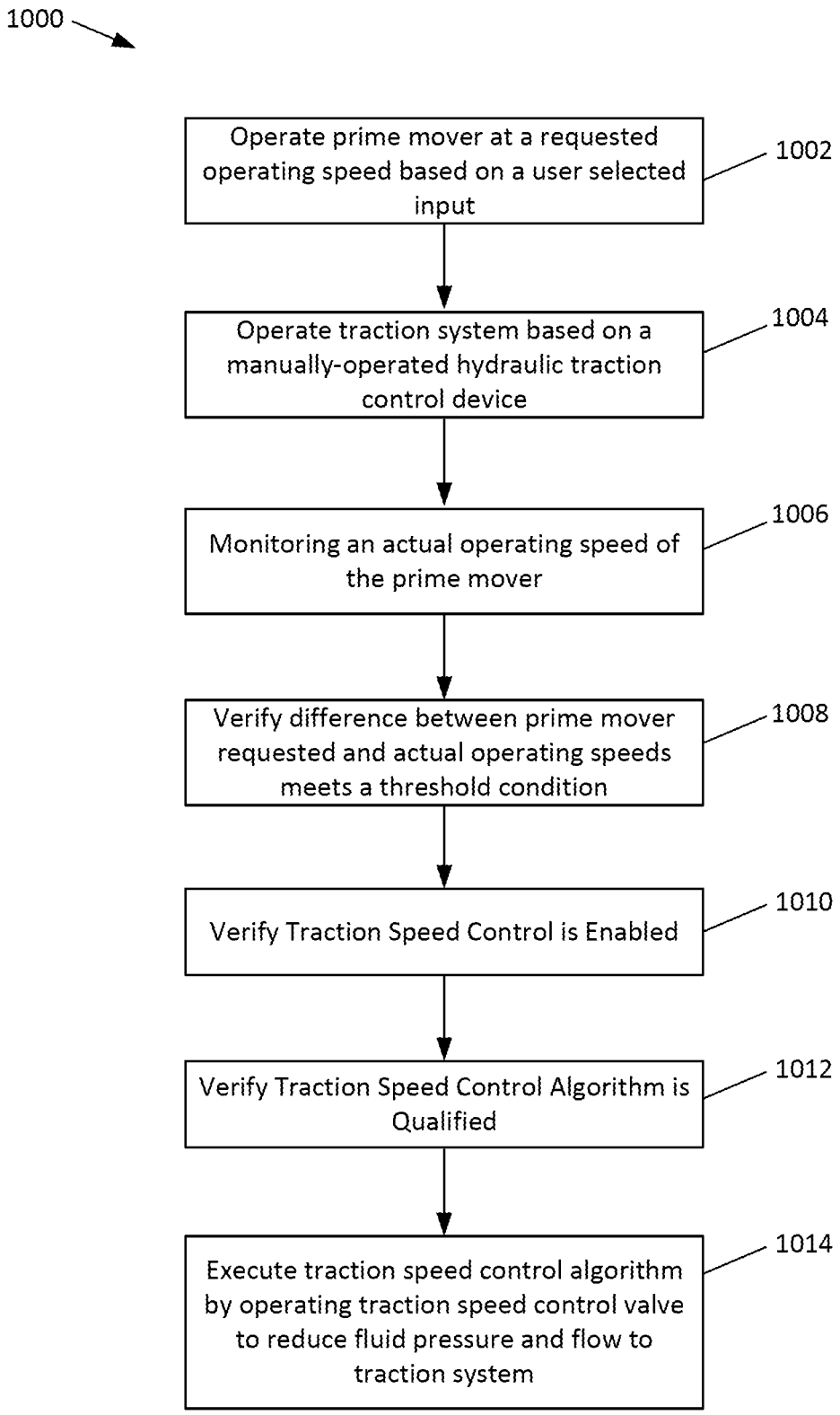
FIG. 7 is a flow chart illustrating operational steps executable by the control system of FIG. 5.

With reference to FIG. 7, a flow chart 1000 is presented illustrating an example operation of the work machine with respect to the traction speed control algorithm. In a step 1002, the prime mover is operated at a requested operating speed based on a user selected input. In one example, the user selected input is the throttle input 140. In another step 1004, the traction system is controlled based on a manually-operated hydraulic traction control device, in contrast to, for example, an electric input to a controller than then sends an electric output to a control valve. In a step 1006, the actual operating speed of the prime mover is monitored. In a step 1008, it is verified whether the difference between the prime mover requested and actual operating speeds meets a threshold condition. In one example, the threshold condition is a fixed RPM value, for example 50 RPM. Other examples are possible, such as a variable RPM value.

In a step 1010, the system verifies whether traction speed control has been enabled by the user. This step may be accomplished, for example, by providing a physical or virtual switch or button at the control panel 128 and verifying that the user has selected to enable traction control. The controller can also be provided with parameters for automatically enabling the traction speed control algorithm which can be used with or without a user input.

In another step 1012, a determination is made whether a qualifying condition exists. One example of a qualifying condition is one in which the speed command of the traction system is above a threshold value. Another example is a condition in which the actual operating speed of the prime mover is above a minimum threshold. Yet another example is a condition in which the requested prime mover operating speed is increasing but where the actual operating speed of the prime mover is decreasing by more than a deadband region. This is a condition where the prime mover is bogging down even though the operating speed command is increasing. A further example is a condition in which the requested prime mover operating speed is increasing but where the actual operating speed of the prime mover is outside of the deadband region. This condition prevents the traction control system from initiating in conditions where the requested prime mover operating speed is increasing and the actual prime mover operating speed is simply lagging behind rather than being in a bogging or loaded condition. The control system can be configured to require all of the above-identified qualifying conditions to be present before initiating the traction speed control algorithm. Other qualifying conditions are possible.

In a step 1014, the traction speed control algorithm is initiated and an output signal is sent by the controller to the traction speed control valve to reduce fluid pressure and flow to traction system using power plant RPM as the only feedback signal. In one example, the algorithm calculates an output signal to the traction speed control valve that includes a PID (proportional-integral-differential) calculation adjustment subtracted from the commanded power plant operating speed. The PID calculation adjustment can be a function of the difference between the actual and commanded prime mover operating speeds. As can be appreciated from the present disclosure, the traction speed control algorithm can be initiated and executed without reliance on a feedback from the traction system of relating to the actual ground speed of the work machine 100, thus reducing cost and complexity of the system.

Figure 8:
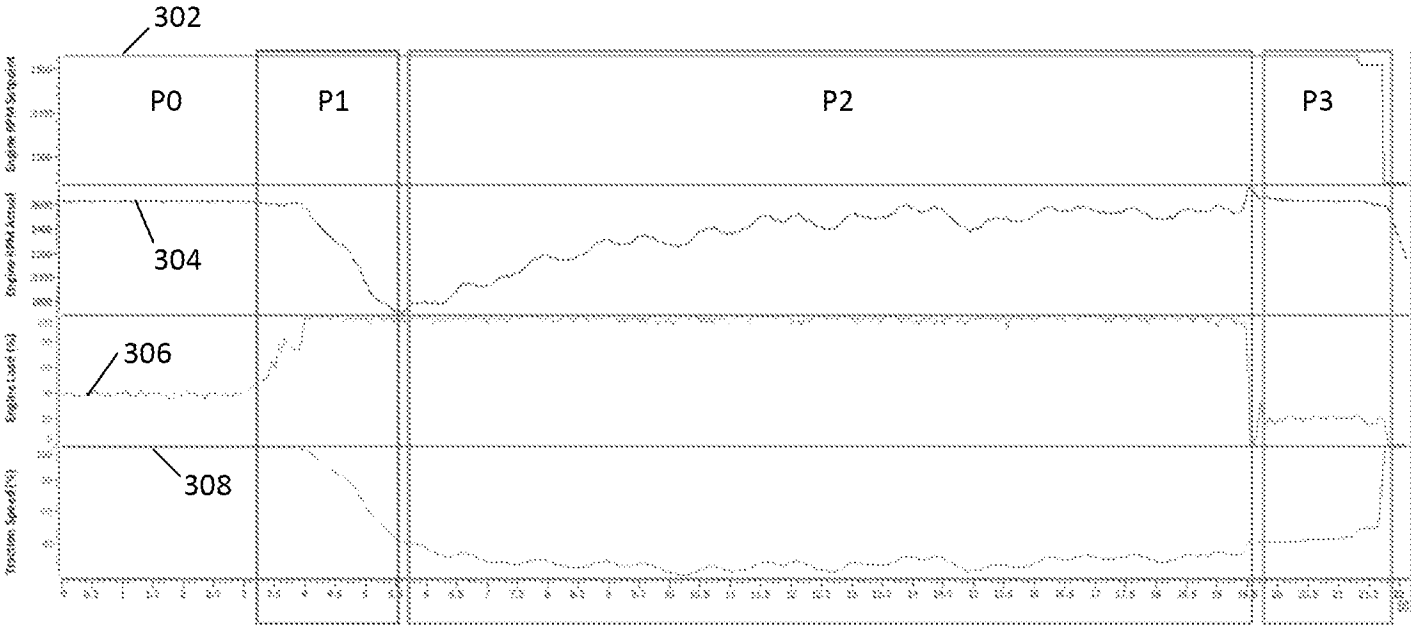
FIG. 8 is a graphical representation of an example operation of the control system FIG. 5.

Referring to FIG. 8, an example output test scenario of the traction speed control algorithm is graphically depicted in which the operation of the work machine 100 transitions through phases P0, P1, P2, P3. In an initial phase P0, the work machine 100 is in a normal operating condition wherein a power plant operating speed setpoint 302 and an actual operating speed 304 are matched, and wherein a load 306 on the power plant is such that an actual traction speed 308 is equal to a maximum speed of the work machine 100. In the phase P1, it can be seen that load 306 on the power plant has increased, therefore causing a reduction in actual power plant operating speed 304 and traction speed 308 sufficient to qualify the traction speed control algorithm to initiate. In the phase P2, the traction speed algorithm has been initiated such that the traction speed 308 is reduced sufficiently to allow the operating speed 304 of the power plant to recover to a certain extent. In the phase P3, the load 306 on the power plant has reduced to a point that the traction speed control algorithm is no longer qualified and the work machine 100 is returned to normal operation.

With the disclosed traction control system, work output is maximized while stalling of the power plant is minimized. Further, the disclosed traction speed control approach can be successfully utilized to optimize power distribution regardless of the type of work attachment mounted to the machine. For example, the same algorithm can be used with a snow thrower attachment and with a trencher attachment to successfully manage power plant loading. However, the traction control system can be provided with multiple traction control algorithms optimized for one or more particular work attachments. In such a case, the appropriate algorithm can be selected by the operator directly or automatically when the work attachment type is identified by or input into the system. Further, the traction speed algorithm can also be used when the power plant experiences loads unrelated to the work attachment, for example when the work machine is climbing an inclined surface.

In some implementations, the control panel 128 can include a user-operated input (e.g., knob, dial, keypad, touch screen, etc.) to set the maximum allowable traction speed and torque through operation of the smart power valve 200. In an aspect, such an input can be used in conjunction with the above-described algorithm and methods such that the input serves as an additional layer for limiting maximum power to the ground engagement assemblies below which the algorithm might ordinarily control the smart power valve 200. In some implementations, the input directly controls the position of the smart power valve 200 independent of the above-described algorithm, via the controller 500. In this latter instance, the operator may desire to reduce available power for other reasons that may not be associated with engine loading. For example, such functionality would be beneficial for making the machine react slower in tight or difficult spaces. Also, the reduced torque in the tracks would help prevent track or wheel slippage and ground damage, such as turf tearing or skid markings.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A mobile work machine comprising:

a) a prime mover supported by a chassis;

b) a traction system including:

i) a ground engagement assembly for propelling the chassis;

ii) a hydraulic pump driven by the prime mover;

iii) a hydraulic motor for driving the ground engagement assembly, the hydraulic motor being powered by the hydraulic pump;

iv) a user-operated traction control device for controlling a hydraulic fluid flow to a control input of the hydraulic pump; and v) a power reduction device for controlling a hydraulic fluid flow to the traction control device;

c) a work attachment powered by the prime mover; and d) an electronic controller for operating the prime mover and the power reduction device, the electronic controller being configured to:

i) operate the prime mover at a requested operating speed based on a user-selected input;

ii) monitor an actual operating speed of the prime mover; and iii) execute a traction speed control algorithm when the actual operating speed of the prime mover relative to the requested operating speed meets a threshold condition in which the position of the power reduction device is operated by the electronic controller to reduce available fluid pressure to the traction control device without receiving an actual traction speed feedback signal at the electronic controller, wherein the electronic controller prevents the traction speed control algorithm from being executed unless a qualifying condition is present beforehand.

2. The mobile work machine of claim 1, wherein the hydraulic motor includes a first hydraulic motor for driving a first traction member of the ground engagement assembly and includes a second hydraulic motor for driving a second traction member of the ground engagement assembly.

3. The mobile work machine of claim 2, wherein the hydraulic pump includes a first hydraulic pump and a second hydraulic pump, wherein the traction control device includes a first traction control device for controlling hydraulic fluid flow from the first hydraulic pump to the first hydraulic motor and includes a second traction control device for controlling hydraulic fluid flow from the second hydraulic pump to the second hydraulic motor.

4. The mobile work machine of claim 3, wherein the power reduction device controls hydraulic fluid flow to both the first and second traction control devices.

5. The mobile work machine of claim 4, wherein the power reduction device is a control valve assembly.

6. The mobile work machine of claim 1, wherein the traction control device delivers hydraulic fluid used as pilot pressure to control the position of a swashplate of the hydraulic pump.

7. The mobile work machine of claim 1, wherein the qualifying condition includes one or more of:

a) a condition in which a speed command of the traction system is not null;

b) a condition in which a speed command of the traction system is above a threshold value;

c) a condition in which the actual operating speed of the prime mover is above a minimum threshold;

d) a condition in which the requested operating speed of the prime mover is increasing but where the actual operating speed of the prime mover is decreasing by more than a deadband region; and e) a condition in which the requested operating speed of the prime mover is increasing but where the actual operating speed of the prime mover is outside of the deadband region.

8. The mobile work machine of claim 1, wherein a commanded position of the power reduction device is calculated by the electronic controller as a function of a requested prime mover operating speed demand and a calculated adjustment factor.

9. The mobile work machine of claim 1, wherein the mobile work machine is a compact utility loader with operator controls and a standing platform located at a rear end of the work machine.

10. The mobile work machine of claim 1, wherein the prime mover is one or both of an internal combustion engine and an electric motor.

11. A mobile work machine comprising:

a) a prime mover supported by a chassis;

b) a traction system including:

i) a ground engagement assembly for propelling the chassis;

ii) a hydraulic motor for driving the ground engagement assembly;

iii) a user-operated traction control device for controlling hydraulic fluid flow to the hydraulic motor; and iv) a power reduction device for controlling hydraulic fluid flow to the traction control device;

c) a work attachment powered by the prime mover; and d) an electronic controller for operating the prime mover and the power reduction device, the electronic controller being configured to:

i) operate the prime mover at a requested operating speed based on a user-selected input;

ii) monitor an actual operating speed of the prime mover;

iii) execute a traction speed control algorithm when the actual operating speed of the prime mover relative to the requested operating speed meets a threshold condition in which the position of the power reduction device is operated by the electronic controller to reduce available fluid pressure to the traction control device, wherein a commanded position of the power reduction device is calculated by the electronic controller as a function of a requested prime mover operating speed demand reduced by a calculated adjustment factor.

12. The mobile work machine of claim 11, wherein the position of the power reduction device is calculated without receiving an actual traction speed feedback signal at the electronic controller.

13. The mobile work machine of claim 11, wherein the traction control device includes a first traction control device for controlling hydraulic fluid flow from a first hydraulic pump to a first hydraulic motor and includes a second traction control device for controlling hydraulic fluid flow from a second hydraulic pump to a second hydraulic motor, and wherein the power reduction device controls flow from the first and second hydraulic pumps to the first and second traction control devices.

14. The mobile work machine of claim 11, wherein the power reduction device is a control valve assembly and the prime mover is one or both of an internal combustion engine and an electric motor.

15. The mobile work machine of claim 13, wherein the traction control device delivers hydraulic fluid used as pilot pressure to control the position of a swashplate of the first and second hydraulic pumps.

16. The mobile work machine of claim 11, wherein the electronic controller prevents the traction speed control algorithm from being executed unless a qualifying condition is present beforehand.

17. A method for controlling the speed of a mobile work machine having a prime mover powering a traction system and at least one work implement, the method comprising:

a) operating the prime mover at a requested operating speed based on a user-selected first input;

b) operating the traction system based on a user-selected second input to a hydraulic traction control device;

c) monitoring an actual operating speed of the prime mover; and d) executing a traction speed control algorithm when the actual operating speed of the prime mover relative to the requested operating speed meets a threshold condition in which a position of a power reduction device is operated by an electronic controller to reduce available fluid pressure to the traction control device, wherein a commanded position of the power reduction device is calculated by the electronic controller as a function of a requested prime mover operating speed demand reduced by a calculated adjustment factor.

18. The method of claim 17, wherein a position of the power reduction device is calculated without receiving an actual traction speed feedback signal at the electronic controller.

19. The method of claim 17, further comprising:

a) preventing the traction speed control algorithm from being executed unless a qualifying condition is present, wherein the qualifying condition includes one or more of:

i) a condition in which a speed command of the traction system is not null;

ii) a condition in which the speed command of the traction system is above a threshold value;

iii) a condition in which the actual operating speed of the prime mover is above a minimum threshold;

iv) a condition in which the requested operating speed of the prime mover is increasing but where the actual operating speed of the prime mover is decreasing by more than a deadband region; and v) a condition in which the requested operating speed of the prime mover is increasing but where the actual operating speed of the prime mover is outside of the deadband region.

* * * * *